United States Patent [19]

Kikuta et al.

[11] Patent Number: 4,539,931

[45] Date of Patent: Sep. 10, 1985

[54] COATING APPARATUS

[75] Inventors: Makoto Kikuta; Hideo Terasawa, both of Hiratsuka, Japan

[73] Assignee: Kansai Paint Co., Ltd., Hyogo, Japan

[21] Appl. No.: 564,083

[22] Filed: Dec. 20, 1983

[30] Foreign Application Priority Data

Dec. 28, 1982 [JP] Japan ..... 57-227533

[51] Int. Cl.[3] ..... B05C 3/09

[52] U.S. Cl. ..... 118/404; 118/DIG. 18; 118/405

[58] Field of Search ..... 118/404, 405, 108, 307, 118/DIG. 18, 125; 184/15.1

[56] References Cited

U.S. PATENT DOCUMENTS 2,602,959 7/1952 Fenlin ..... 118/405 X
4,169,427 10/1979 Crump et al. ..... 118/307

FOREIGN PATENT DOCUMENTS 150461 9/1983 Japan .
26778 12/1907 United Kingdom ..... 184/15.1

*Primary Examiner*—John P. McIntosh
*Attorney, Agent, or Firm*—Wenderoth, Lind & Ponack

[57] ABSTRACT

An improved coating apparatus including a paint vessel having an opening at its bottom for passing of an object to be coated therethrough, a sealing member disposed below the opening of said paint vessel and having an opening for passing of the coating object therethrough, a supporting section for supporting the paint vessel and a driving section for moving the paint vessel relative to the object to be coated. The sealing member has a brush to be in contact with the coating object passing through its opening and an elastic member provided exteriorly of the brush for pressing the brush against the object.

6 Claims, 9 Drawing Figures

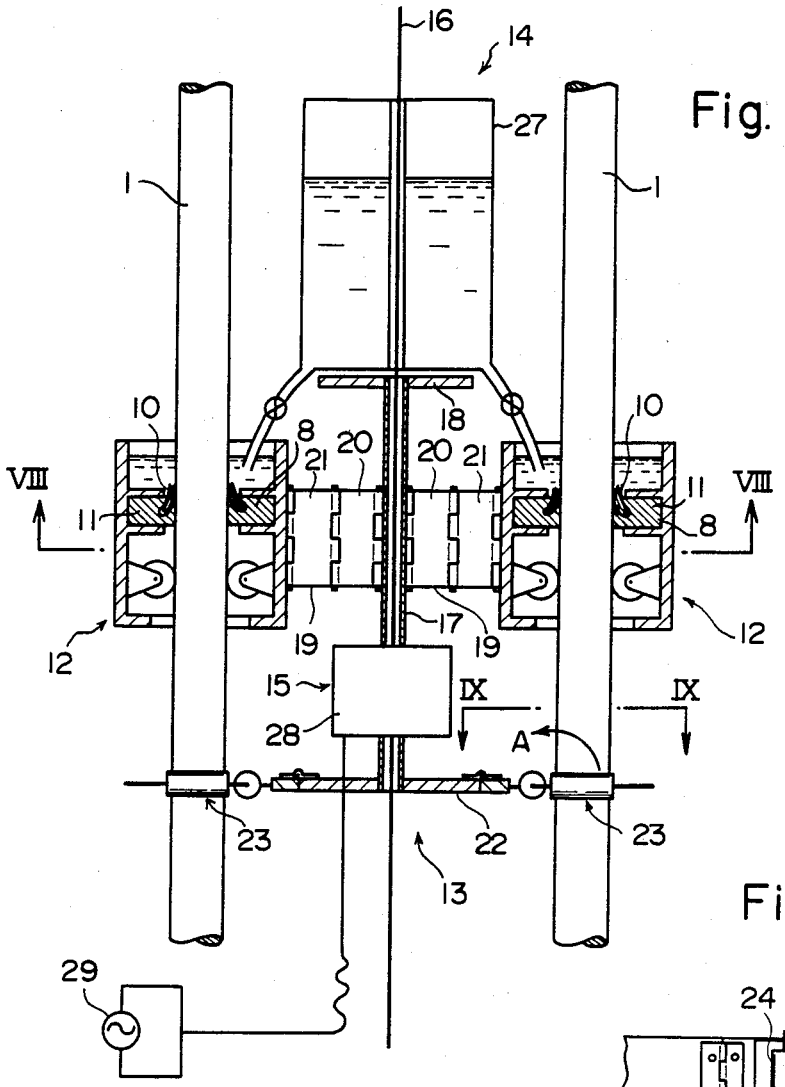
Fig. 7
Fig. 9
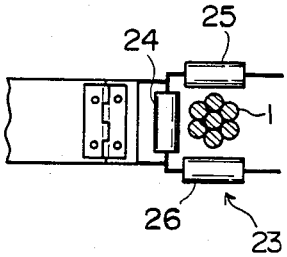
Fig. 8
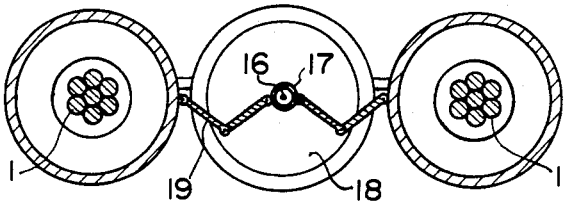

COATING APPARATUS

BACKGROUND OF THE INVENTION

1. Field of the Invention

This invention relates to a coating apparatus for coating a long object.

More specifically, this invention relates to a coating apparatus comprising a paint vessel having an opening at its bottom for passing of an object to be coated therethrough and a driving section for moving the paint vessel relative to the object, and further including a sealing member having excellent sealability provided below the opening of the paint vessel.

2. Description of the Prior Art

Heretofore, long articles have been coated by blade coating, for example by using a die, a roll, a brush, or a belt, or by passing such an article through a die having nearly the same outer shape as the article. With these methods, the speed of shearing becomes high during the coating operation, and it is difficult to obtain a relatively thick coated film uniformly. Furthermore, when the object to be coated has raised and depressed areas, a uniform film thickness is difficult to obtain.

It is also known to dip-coat a long article by utilizing a fixed vessel containing a coating agent. With this method, however, it is extremely difficult to coat articles which are very long, have a large weight, or are difficult to convey.

For this reason, a long article having a large weight has been coated by manual brush coating, for example by a manual operation conducted by a worker sitting on a chair suspended by a rope, or by a worker getting on a gondola. Such methods, however, can be unsafe when performed at high altitude, environmentally hazardous due to scattering of the coating solution is undesirable for environmental hygiene, and the working efficiency is low because of the manual operation.

The present inventors proposed in Japanese Laid-Open Patent Publication No. 150461/1983 (Japanese Patent Application No. 30584/1982) a coating apparatus suitable for coating a long article fixedly provided in the vertical direction, such as hanger ropes of a suspension bridge. This coating apparatus comprises a paint vessel having an opening at its bottom for passing of a coating object therethrough, and a driving section for moving the paint vessel relative to the coating object. This apparatus further includes a sealing member below the opening of the paint vessel, which is disposed rotatably in a holder and has a hole having a shape corresponding to the cross-sectional shape of an object.

This coating apparatus has excellent advantages. For example, it can coat a long article with good efficiency, but is still desired to be improved in many respects. For example, when irregularly raised and depressed portions exist on the surface of a coating object such as a hanger rope or the coating object varies in cross-sectional shape owing to multicoat coating, it is not always easy to make the inside surface of the sealing member conform to the outer shape of the hanger rope. If the hole of the sealing member is larger than the outer shape of the hanger rope, the paint tends to leak. If it is smaller, friction increases and a smooth descending motion becomes difficult.

Furthermore, when the material from which the sealing member is made is too hard, it injures the surface of the hanger rope or gets caught by the raised and depressed portions on the surface of the rope, and the motion of the coating apparatus might not be performed smoothly. On the other hand, if the sealing member is too soft, the rotating sealing member undergoes marked deformation in the vicinity of the periphery of the hanger rope and the clearance between the hanger rope and the sealing member increases. As a result, the coating solution tends to leak, and the selection of the material for the sealing member is difficult.

Furthermore, when the space between the sealing member and a holder therefor is too large, the coating solution tends to leak. If it is too narrow, the rotation of the sealing member is prevented and the coating apparatus does not operate smoothly. Hence, this space should be of a specified magnitude with a sufficient accuracy.

SUMMARY OF THE INVENTION

The present invention has been made in view of the above state of the art.

It is an object of this invention to provide a coating apparatus suitable for coating a long article.

Another object of this invention is to provide a coating apparatus particularly suitable for conveniently coating a coating object which has a large weight or is difficult of moving because of being fixedly provided, and has a complex cross-sectional shape as in a hanger rope for a suspension bridge.

Another object of this invention is to provide a coating apparatus comprising a device which has good sealing property even when irregularly raised and depressed portions exist on the surface of a coating object or its cross-sectional shape changes because of multicoat coating.

According to this invention, the above and other objects of this invention are achieved by a coating apparatus comprising a paint vessel having an opening at its bottom for passing of a coating object to be coated therethrough, a sealing member disposed below the opening of said paint vessel and having an opening for passing of the object therethrough, a supporting section for supporting the paint vessel and a driving section for moving the paint vessel relative to the object, said sealing member having a brush to be in contact with the object passing through its opening and an elastic member provided exteriorly of the brush.

BRIEF DESCRIPTION OF THE ACCOMPANYING DRAWINGS

The above and other objects are accomplished by the novel features of the present invention which will become apparent from the following description taken in conjunction with the accompanying drawings in which:

FIG. 7 is a partial sectional side elevation of the coating apparatus of the invention in accordance with a second embodiment;

FIG. 8 is a cross-sectional view taken along line VIII—VIII of FIG. 7; and

FIG. 9 is a cross-sectional view taken along line IX—IX of FIG. 7.

DETAILED DESCRIPTION OF THE PREFERRED EMBODIMENT

The first embodiment of the coating apparatus of this invention will be described below with reference to FIGS. 1 to 6.

Figure 1:
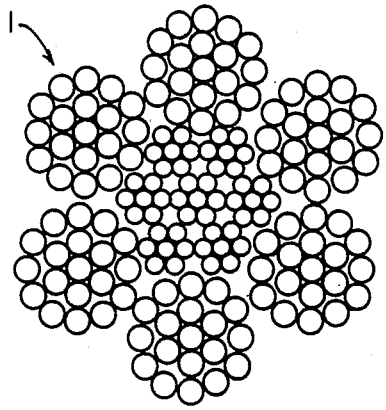
FIG. 1 is a cross sectional view of a suspension cable as one example of a coating object.
Figure 2:
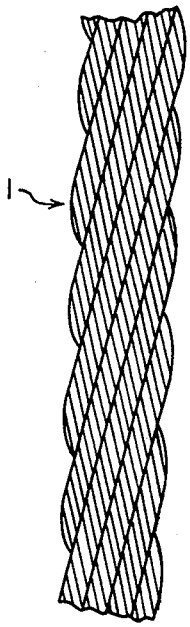
FIG. 2 is a side elevation of the cable.

FIGS. 1 and 2 are a sectional view and a side elevation, respectively, of a suspension cable 1 for a suspension bridge which is one example of an object to be coated. As shown, the cables 1 is made by twisting a plurality of steel wires helically, and therefore, helical raised and depressed portions are formed on its periphery.

Figure 3:
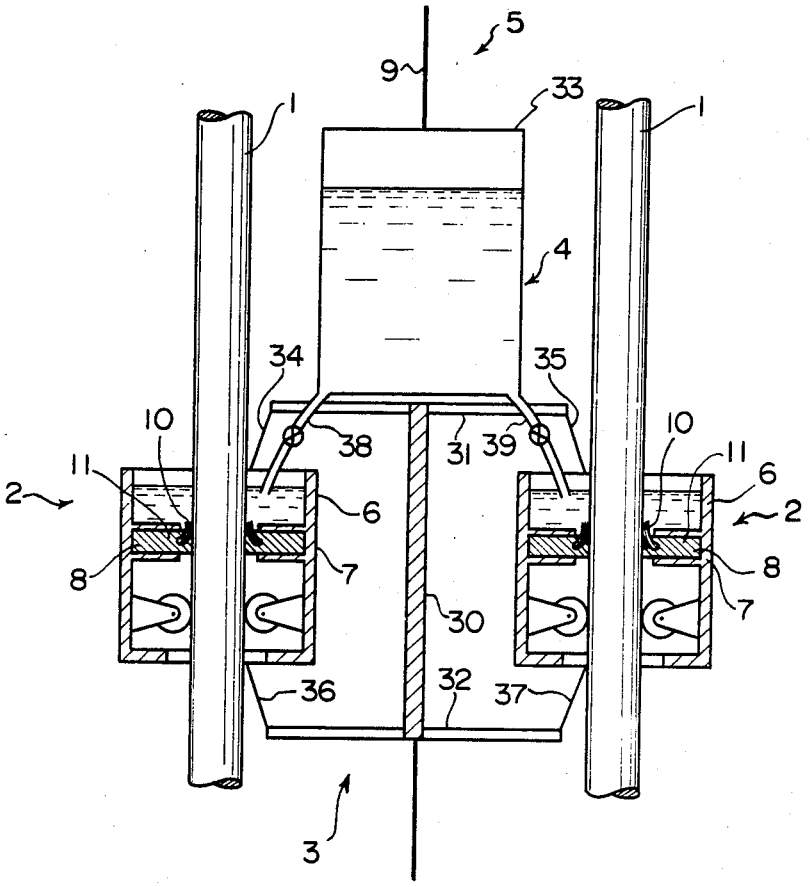
FIG. 3 is a partial sectional side elevation of a first embodiment of the coating apparatus of the invention.

As shown in FIG. 3, the coating apparatus according to a first embodiment of this invention is comprised of two coating sections 2, a supporting section 3, a paint feeding section 4 and a driving section 5. Each coating section 2 is provided for each of two cable 1 to be coated. The coating section 2 has a paint vessel 6 having an opening formed at its bottom. The cable 1 extends through this opening. A holder 7 is provided at the bottom of the paint vessel 6 surrounding the opening. The holder 7 holds a sealing member 8. A circular hole having nearly the same shape as the cross-section of the cable and a hole for holding a brush 10 are provided in the inside of the sealing member 8, and the brush is provided as described in detail hereinbelow. The periphery of the sealing member 8 is formed in a circular shape, and the sealing member 8 is, on the whole, in the form of a disc having a hole at its center. The holder 7 is constructed of a side wall and a bottom wall forming a cylinder having a radius and height nearly equal to the radius and height of the sealing member 8. In performing the coating operation, a paint is supplied from the paint feeding section 4 to the paint vessel 6, and then by operating a winder, a driving rope 9 is continuously unwound to lower the paint vessel 6.

The supporting section 3 has a frame consisting of a vertically disposed longitudinal bar 30 and two lateral bars 31 and 32 provided respectively at the upper and lower ends of the longitudinal bar 30, as shown in FIG. 3. A paint tank 33 is fixed to the upper lateral bar 31. Both ends of the two lateral bars 31 and 32 and the coating sections 2 are connected by wires 34, 35, 36 and 37 so that the coating sections 2 can move horizontally within a restricted range.

The paint feeding section 4 is comprised of the paint tank 33 fixed to the upper lateral bar 31 and feed pipes 38 and 39 for feeding the paint to the coating sections 2 from the paint tank 33. If required, a valve may be provided in the feed pipes 38 and 39 as shown in FIG. 3. At the time of feeding the paint, the paint tank 33 communicates with its exterior only through the feed pipes 38 and 39 whereby the paint in the paint vessel 6 is maintained at a fixed level.

The driving rope 9 is adapted to be moved up and down by the winder. The driving rope 9 is connected to the upper end of the paint tank 33 and the lower end of the longitudinal bar 30 of the frame. By operating the winder, the coating apparatus can be moved up and down.

Now, with reference to FIGS. 4 to 6, the sealing member 8 used in the first embodiment will be described in greater detail.

Figure 4:
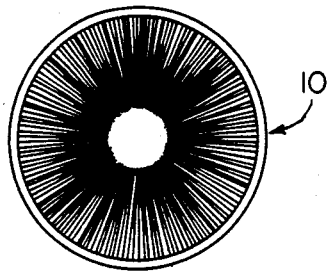
FIG. 4 is a top plan view of a brush as part of the coating apparatus of the invention in accordance with the first embodiment.

FIG. 4 shows a top plan view of the brush 10 disposed on the outside surface of the suspension cable 1. As shown in FIGS. 4 and 5, the tips of its bristles extend centrally, and the diameter of the central hole is smaller than the minimum distance from the center to the peripheral surface of the object to be coated (the suspension cable 1).

In FIG. 4, the brush 10 is formed in the shape of a ring, but it may be composed of a plurality of brushes.

Figure 5:
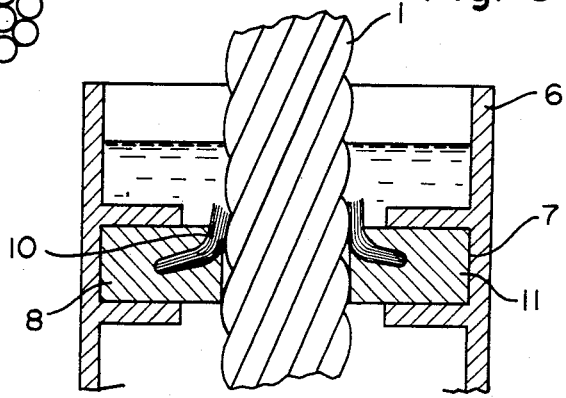
FIGS. 5 and 6 are a sectional view and a top plan view of the paint vessel and the hole portion of the coating apparatus of the invention in accordance with the first embodiment.
Figure 6:
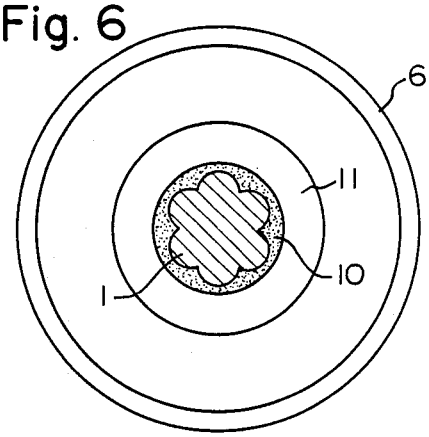

FIGS. 5 and 6 are a sectional view and a top plan view of the paint vessel 6 and the holder 7 and their vicinity.

When the brush 100 is disposed on the outside surface of the cable 1, it is pressed by the cable 1 and because of its pliability and elasticity, the brush 10 gets into the depressed portions of the cable 1 and spreads on its raised portions, thus covering the entire periphery of the hanger rope 1. Hence, the brush 10 seals up the paint which tends to leak along the outside surface of the cable 1 and supplies the paint to the depressed portions of the cable 1. The bristles of the brush may, for example, be animal hairs such as horse hairs or plastic bristles such as nylon bristles. The material, diameter, length and thickness of the bristles can be varied by considering the properties of the paint and the shape of the object to be coated.

An elastic member 11 is disposed exteriorly of the brush 10. The outside diameter and height of the elastic member 11 are made nearly equal to those of the holder 7. The elastic member 11 has formed therein a circular hole having nearly the same shape as the outer shape of the cable 1 and a hole for holding the brush 10. Since the holder 7 applies pressure to the elastic member 11, there is scarcely any space between the elastic member 11 and the brush 10 and between the elastic member 11 and the holder 7, and the amount of the paint which can leak between these elements is extremely small.

During the coating operation, the brush 10 and the elastic member 11 move as a unit with the coating section in the axial direction of the cable 1. When only the brush 10 is disposed on the outside surface of the cable 1, the elasticity of the bristles of the brush 10 cannot follow the turns of the cable grooves and the irregularly raised and depressed portions on the outside surface of the cable and a space may form between the cable 1 and the brush 10. However, if the elastic member 11 is provided exteriorly of the brush 10, the elastic member 11 presses the brush 10 against the cable 1 in response to changes in the outside surface thereof. Hence, the space between the cable 1 and the brush 10 is small, and leakage of the paint therebetween is very small.

The elastic member 11 may be made of a material which has excellent resistance to solvents can be easily deformed elastically and has moderate suppleness and hardness i.e. is "spongu", such as a plastic sponge, rubbers, etc.

The operation of the coating apparatus of the invention in accordance with the first embodiment will be described.

The brush 10 is disposed so as to surround the cable 1, and the elastic member 11 is further provided exteriorly of the brush 10. The brush 10 and the elastic member 11 are each composed of two splittable portions, or are cut through one cutting surface from the hole inside to the periphery, although this is not shown in the drawings. As a result, these materials can be mounted without detaching the cable 1 which has already been provided.

Then, the paint vessel 6 is split along a dividing surface through its central axis, and is installed so that the elastic member 11 is supported by the holder 7 and the paint vessel 6 surrounds the cable 1.

A paint is fed from the paint feeding section 4 to the paint vessel 6, and by operating the winder, the driving rope 9 is successively unwound to lower the paint vessel 3.

The brush 10 and the elastic member 11 together with the supporting section 3 and the feeding section 4 make a rectilinear motion axially of the cable 1. Since the paint infiltrates the space between the brush 10 and the cable 1, the frictional force between them is relatively low and the surface of the cable 1 is not damaged nor is the brush 10 worn. Furthermore, since the entire periphery of the cable 1 is covered with the brush 10, and the elastic member 11 is disposed exteriorly of the brush 10, the amount of the paint which may leak is extremely small even when irregularly raised and depressed portions exist on the surface of the cable 1 or the cross-sectional shape of the cable 1 changes owing to multicoat coating. Consequently, the coating operation can be performed smoothly.

Now, with reference to FIGS. 7 to 9, the coating apparatus of this invention in accordance with a second embodiment will be described.

The coating apparatus in accordance with the second embodiment is comprised of two coating sections 12, a supporting section 13, paint feeding section 14 and a driving section 15.

Each of the coating sections 12 is constructed in the same way as in the coating section 2 shown in FIG. 3, and has a sealing member 8 composed of the brush 10 and the elastic member 11 shown in FIG. 5.

The supporting section 13 has a hollow pipe 17 through which a driving rope 16 extends. An upper supporting plate 18 having an opening through which the rope 16 extends is fixed to the top of the hollow pipe 17. A paint vessel 27 is fixed to the upper surface of the upper supporting plate 18. A pair of bifolding supporting plate members 19 are provided as shown in FIG. 7 in the hollow pipe 17 in order to support the coating section 12. Each of the supporting members 19 includes a first plate 20 and a second blade plate 21. The hollow pipe 17 and the first plate 20, the first plate 20 and the second plate 21, and the second plate 21 and the coating section are each connected by a double-leaf hinge. As a result, the coating section 12 can move horizontally with respect to the hollow pipe 17 within a restricted range.

A driving device 28 for raising and lowering the driving section 15 is further fixed to the hollow pipe 17 of the supporting section 13. To the lower end of the hollow pipe 17 is fixed a lower supporting plate 22 having a hole through which the driving rope 16 extends. Roller assemblies 23 are connected to the respectively opposite end portions of the lower supporting plate 22 by means of double-leaf hinges. As shown in FIG. 9, each of the roller assemblies 23 is comprised of a first roller 24 on its inside and second and third rollers 25 and 26 on its two lateral sides. Since the roller assemblies 23 are connected to the lower supporting plate 22 by double-leaf hinges and no roller is provided on the outside thereof, they can be folded inwardly as shown by an arrow A in FIG. 7. A locking mechanism is provided to hold the roller assemblies 23 in the extended position shown in FIG. 7. Desirably, the rollers 24, 25 and 26 are made of soft materials such as rubbers, felt or plastics so as not to injure the surface of the cable 1.

The paint feeding section 14 is provided with a paint vessel 27, etc. shown in FIG. 3. The paint vessel 27, however, differs from the paint vessel 33 shown in FIG. 3 in that the paint vessel 27 is divided into two portions and the rope 16 is adapted to pass therethrough.

Driving rope 16 is vertically fixed (that is, unlike the first embodiment, it is provided in a manner not to be movable vertically). The driving device 28 is provided with a driving motor (not shown), a drive wheel to be rotated by the driving motor and an idle wheel, and the rope 16 is held under pressure between the drive wheel and the idle wheel. By supplying power from a power supply 29 and operating the driving motor, the coating apparatus is moved upwardly or downwardly as desired. The moving speed or direction of the coating apparatus can be adjusted by using a known frequency converter, for example.

The cable 1 can be coated by the coating apparatus of the second embodiment by continuously lowering it in the same way as in the first embodiment.

Since in the coating apparatus of the second embodiment, the hollow pipe 17 of the supporting section 13 and the coating section 12 are connected by the plates 20 and 21 which are connected by double-leaf hinges, the hinged plates 20 and 21 alleviate the effect of the changing of the distance between cable 1, or the effect of shaking of the coating apparatus which may occur owing to wind or otherwise. Preferably, the connection between the coating section 12 and the second plate 21 can be released so that only the coating section 12 can be washed and cleaned, or the mounting and detaching of the cable on and from the coating section 12 may be carried out easily.

Because the coating apparatus in accordance with the second embodiment has the roller assemblies 23, the coating apparatus as a whole does not tilt greatly even when the friction resistance between one coating section 12 and the cable 1 increases. Furthermore, in the coating apparatus of the second embodiment, the hollow pipe 17 and the coating section 12 are connected by the supporting plates. Hence, the coating section 12 can be moved horizontally with respect to the hollow pipe 17, but is maintained always parallel to the hollow pipe 17. Consequently, the sealing member 8 is prevented from being partly caught by the cable to cause tilting of the coating section 12.

In the first and second embodiments described hereinabove, the apparatus has two coating sections and the driving rope extends centrally of the apparatus to obtain a weight balance. Otherwise, it is desirable to maintain the weight balance of the entire apparatus by, for example, attaching a weight.

It is to be understood that the driving section, the supporting section, etc. described hereinabove are merely illustrative, and various similar mechanisms may be used without departing from the scope of the invention.

What is claimed is:

1. A coating apparatus comprising:

a coating vessel for containing a quantity of coating liquid, said vessel having a first hole therein for passing an object to be coated through the bottom thereof;

a support section supporting said vessel;

a sealing section disposed below said vessel having a second hole for receiving the object to be coated therethrough; said sealing section including a brush in said second hole, having a third hole therein for receiving the object to be coated therethrough with the brush in contact with the exterior of the object to be coated, and an elastic member supporting said brush radially outside of said brush inside said second hole so as to urge said brush against the outside surface of the object to be coated, and a drive means for moving said vessel, said support section and sealing section relative to the object to be coated passing through said first, second and third holes.

2. An apparatus as in claim 1, wherein said brush is ring shaped and said elastic member surrounds said brush, whereby if the object to be coated is a cable, said elastic member presses the bristles of said brush into any grooves and irregularities at the surface of the cable.

3. An apparatus as in claim 1, wherein said elastic member is spongy.

4. A coating apparatus as in claim 3, wherein said elastic member extends radially inward adjacent said brush so as to engage the outer surface of the object to be coated passing through said third hole.

5. An apparatus as in claim 1, wherein said driving means includes a driving rope and a winder connected to one end of said rope for moving said rope vertically, said support section including a frame connected to said rope and a wire connecting said frame to said vessel.

6. An apparatus as in claim 1, wherein said driving means includes an extended fixed rope and means, fixed to said support section and engaging said rope for moving said vessel, said support section and said sealing member relative to said rope; said support section including a longitudinally extending hollow pipe, said rope extending through said pipe, a first plate member and a second plate member extending laterally of said hollow pipe between said hollow pipe and said vessel, and first, second and third hinges respectively pivotally connecting one lateral side of said first plate to said pipe, the other lateral side of said first plate to one lateral side of said second plate, and the other lateral side of said second plate to said vessel.

* * * * *